US005894646A

United States Patent [19]

Hanafy et al.

[11] Patent Number: 5,894,646

[45] Date of Patent: Apr. 20, 1999

[54] METHOD FOR THE MANUFACTURE OF A TWO DIMENSIONAL ACOUSTIC ARRAY

[75] Inventors: Amin M. Hanafy, Los Altos Hills, Ohio; Vaughn R. Marian, Saratoga, Colo.

[73] Assignee: Acuson Corporation, Mountain View, Calif.

[21] Appl. No.: 08/450,475

[22] Filed: May 26, 1995

Related U.S. Application Data

[62] Division of application No. 08/182,298, Jan. 14, 1994, abandoned.

[51] Int. Cl.[6] ..... H04R 17/00

[52] U.S. Cl. ..... 29/25.35; 29/854

[58] Field of Search ..... 29/25.35, 854; 310/334–337

[56] References Cited

U.S. PATENT DOCUMENTS

| | | | |
|---|---|---|---|
| 3,833,825 | 9/1974 | Haan | 310/9.5 |
| 3,952,387 | 4/1976 | Iinuma et al. | 29/25.35 |
| 3,979,711 | 9/1976 | Maginness | 340/1 |
| 4,277,712 | 7/1981 | Hanafy . | |
| 4,404,489 | 9/1983 | Larson, III et al. | 29/25.35 X |
| 4,437,033 | 3/1984 | Diepers | 367/155 |
| 4,445,380 | 5/1984 | Kaminski | 73/642 |
| 4,592,029 | 5/1986 | Altmann et al. . | |
| 4,742,494 | 5/1988 | Breimesser et al. . | |
| 4,783,888 | 11/1988 | Fujii et al. | 29/25.35 |
| 4,825,115 | 4/1989 | Kawabe et al. | 29/25.35 X |
| 5,267,221 | 11/1993 | Miller | 367/155 |
| 5,335,209 | 8/1994 | Jaenke | 367/155 |

FOREIGN PATENT DOCUMENTS

| | | |
|---|---|---|
| 0 294 826 | 12/1988 | European Pat. Off. . |
| 0 451 984 | 10/1991 | European Pat. Off. . |

OTHER PUBLICATIONS

Goldberg and Smith, *Performance of Multi–Layer 2–D Transducer Arrays*, 1993, pp. 1103–1106.

Skinner, D.P. et al., "Flexible Composite Transducers," Mat. Res. Bull., vol. 13, pp. 599–607 (1978).

Smith, S.W. et al., "Two–Dimensional Arrays for Medical Ultrasound," Ultrasonic Imaging, vol. 14, No. 3, pp. 213–233 (1992).

Newnham, D.P., et al., "Connectivity and Piezoelectric–Pyroelectric Composites," Mat. Res. Bull., vol. 13, pp. 525–536 (1978).

*Primary Examiner*—Carl E. Hall

*Attorney, Agent, or Firm*—Brinks Hofer Gilson & Lione

[57] ABSTRACT

There is provided a two-dimensional array for use in an acoustic imaging system which comprises a plurality of transducer segments each having a trace for exciting an electrode on each of the transducer segments, the trace and the electrode being formed of the same material. The two-dimensional array is capable of imaging deeper in the human body at higher frequencies and provides more reliable lead attachments to the respective segments forming the array. Methods of manufacturing the two-dimensional array are further provided.

16 Claims, 4 Drawing Sheets

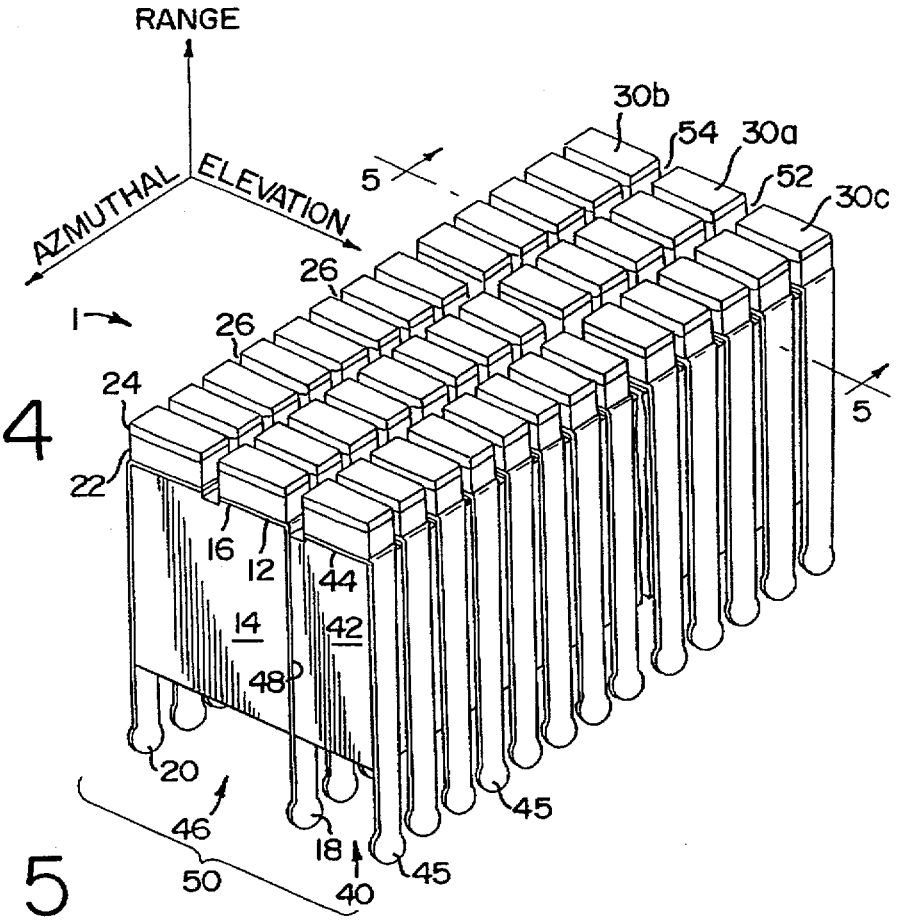
FIG. 4
FIG. 5
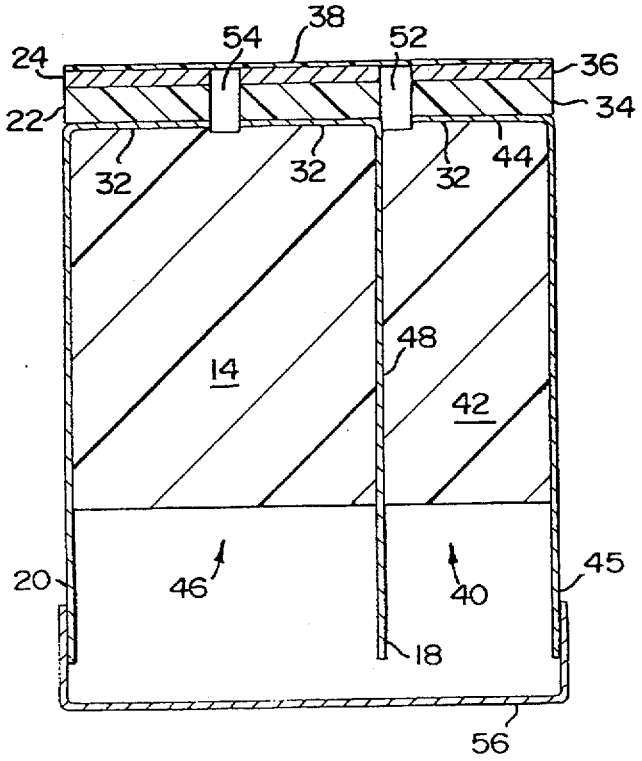
FIG. 7
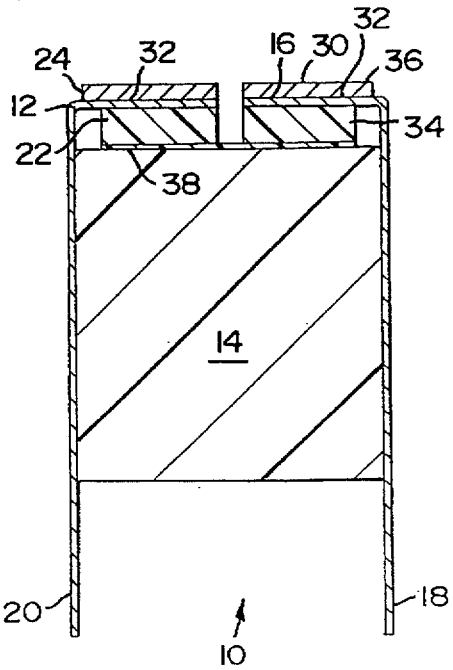

METHOD FOR THE MANUFACTURE OF A TWO DIMENSIONAL ACOUSTIC ARRAY

This application is a division of application Ser. No. 08/182,298, filed Jan. 14, 1994, now abandoned.

FIELD OF THE INVENTION

This invention relates to acoustic transducers and more particularly to a two-dimensional transducer array for use in the medical diagnostic field.

BACKGROUND OF THE INVENTION

Ultrasound machines are often used for observing organs in the human body. Typically, these machines contain transducer arrays, which are comprised of a plurality of individually excitable transducer segments, for converting electrical signals into pressure waves. The transducer array may be contained within a hand-held probe, which may be adjusted in position to direct the ultrasound beam to the region of interest. Electrodes are placed upon opposing portions of the transducer segments for individually exciting each segment. The pressure waves generated by the transducer segments are directed toward the object to be observed, such as the heart of a patient being examined. Each time the pressure wave confronts an interface between objects having different acoustic characteristics, a portion of the pressure wave is reflected. The array of transducers may receive and then convert the reflected pressure wave into a corresponding electrical signal.

Two-dimensional transducer arrays are desirable in order to allow for increased control of the excitation along an elevation axis, which is otherwise absent from conventional single-dimensional arrays. A two-dimensional transducer array has at least two transducer segments arranged along each of the array's elevation and azimuthal axes. Typically in a two-dimensional transducer array there are 128 transducer segments along the array's azimuthal axis and two or more segments along the array's elevation axis. As a result of the two-dimensional geometry, one is able to control the scanning plane slice thickness for clutter free imaging and better contrast resolution.

It is desirable to form high density two-dimensional transducer arrays because they are compact and may provide clearer images. However, prior art high density two-dimensional arrays are typically difficult to fabricate because the width of the transducer elements is generally 50 to 100 μm. In order to produce a high density two-dimensional transducer array, many leads or traces are soldered to the small individual transducer segments in the array in order to provide the appropriate electrical signals for excitation. Thus, on a typical two-dimensional transducer array, hundreds of traces must be soldered to the respective segments to effect excitation.

As a result of the high density form of the arrays, prior art two-dimensional transducer arrays typically have unreliable lead attachments to the respective transducer segments. The dimensions of the segments are small and the connections between the traces and the transducer segments may fail. In addition, the traces and solder connections are subject to heating and cooling and may not withstand the temperature changes. As a result, these connections may break apart. Yields as low as 10 percent for producing high density two-dimensional arrays are not uncommon. Consequently, prior art methods for constructing high density two-dimensional transducer arrays have generally been complex, unreliable, and cost prohibitive from a yield point of view.

In addition to the problem of unreliable lead attachments, typical prior art transducers operating at higher frequencies with the larger elevation aperture of the two-dimensional array will clutter imaging in the shallow portions of the human body. It is desirable to image regions deep within the human body at higher frequencies, while maintaining the ability to generate clear near-field images. Generally, higher frequency transducer arrays having a smaller elevation aperture are used to improve the resolution of sectional plane images of shallow regions within the human body.

Higher ultrasonic frequencies, however, are more quickly attenuated in the human body. Therefore, in conventional ultrasound systems, lower frequencies of ultrasonic waves are generally used to improve the resolution of sectional plane images of deeper regions within the human body. Nonetheless, clearer images of deeper regions within the human body may be generated if the transducer array is capable of providing higher ultrasonic frequencies from an expanded or larger elevation aperture while also being capable of maintaining clutter free near field images. Clutter free near field images may be produced if the same transducer array is capable of providing higher ultrasonic frequencies from a smaller elevation aperture (i.e., switching-in a smaller elevation aperture).

SUMMARY OF THE INVENTION

There is provided in a first aspect of this invention a two-dimensional array for use in an acoustic imaging system which comprises a plurality of transducer segments each having a trace for exciting an electrode on each of the transducer segments, the trace and the electrode being formed of the same material.

According to a second aspect of this invention, there is provided a two-dimensional array for use in an acoustic imaging system which comprises a plurality of transducer segments, each of the segments having a first piezoelectric portion, a second piezoelectric portion, a first electrode, a second electrode and a third electrode. The first piezoelectric portion is disposed on the first electrode, the second electrode is disposed between the first piezoelectric portion and the second piezoelectric portion. The second electrode has a trace for electrically exciting the segment, the second electrode and the trace forming a one-piece member. Further, the third electrode is electrically connected to an opposing surface of the second piezoelectric portion.

According to a third aspect of this invention, there is provided a two-dimensional array for use in an acoustic imaging system which comprises an interconnecting circuit having a first plurality of traces extending along a first side and a second plurality of traces extending along a second opposing side. A piezoelectric layer is disposed on the interconnecting circuit, the interconnecting circuit and piezoelectric layer being diced to form individual transducer segments. Further, an electrode layer is electrically connected to the piezoelectric layer.

According to a fourth aspect of this invention, there is provided a two-dimensional array which comprises at least two transducer segments arranged along an elevation direction, each of the transducer segments having a trace for exciting an electrode on each of the transducer segments, the trace and electrode being a one-piece member.

A first preferred method of constructing a two-dimensional transducer array comprises the steps of disposing an interconnecting circuit on a support structure having a first plurality of traces extending along one side of the support structure and a second plurality of traces extending along a second opposing side of the support structure, placing a piezoelectric layer on the interconnecting circuit, dicing the piezoelectric layer and interconnecting circuit to form a plurality of transducer segments, and disposing an electrode layer on the diced transducer segments. Each of the segments is electrically coupled to one of the traces.

A second preferred method of constructing a two-dimensional transducer array comprises the steps of disposing an electrode layer on a support structure having a first and an opposing second side, disposing a piezoelectric layer on the electrode layer, disposing an interconnecting circuit on the piezoelectric layer having a first plurality of traces extending along the first side of the support structure and a second plurality of traces extending along the second side of the support structure, and dicing the piezoelectric layer and the interconnecting circuit to form a plurality of transducer segments. Each of the segments are electrically coupled to one of the traces.

BRIEF DESCRIPTION OF THE DRAWINGS

FIG. 4 is a perspective view of a second embodiment of the two-dimensional acoustic array of the present invention employing a single crystal design having a matching layer, and having three transducer segments in the elevation direction.

FIG. 5 is a cross-sectional view of the acoustic array of FIG. 4 taken along the lines 5—5 and also illustrating the mylar shield ground return.

FIG. 7 is a cross-sectional view of a third embodiment of the present invention employing a single crystal design having two-segments in the elevation direction and having a flexible circuit disposed under a matching layer.

DESCRIPTION OF THE PREFERRED EMBODIMENTS

Figure 1A:
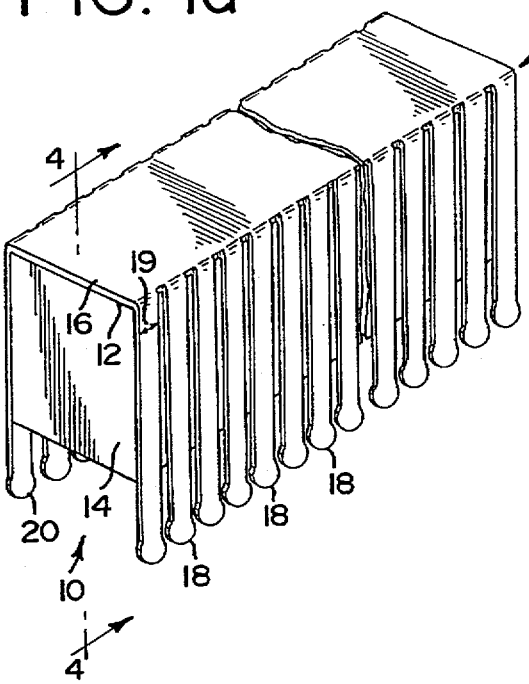
FIG. 1(*a*) is a perspective view of a flexible circuit placed over a backing block forming an assembly and FIG. 1(*b*) further has a piezoelectric layer and matching layer disposed on the assembly.
Figure 1B:
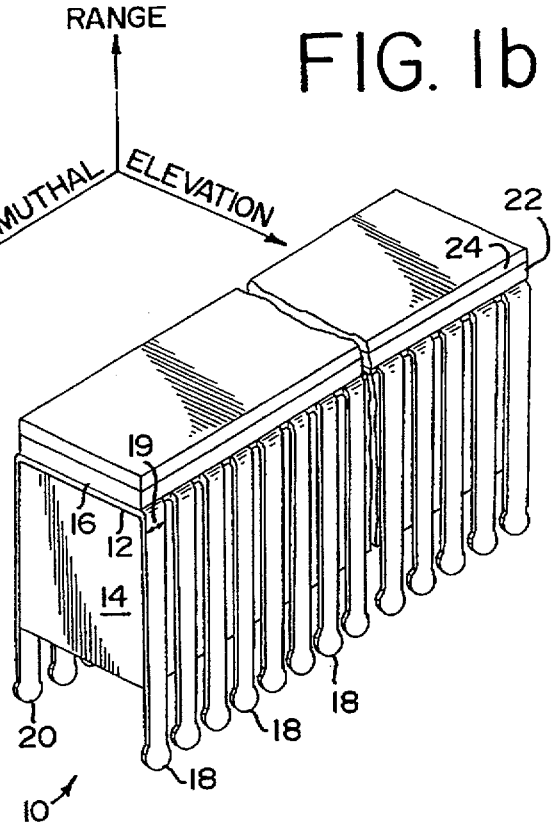
Figure 2:
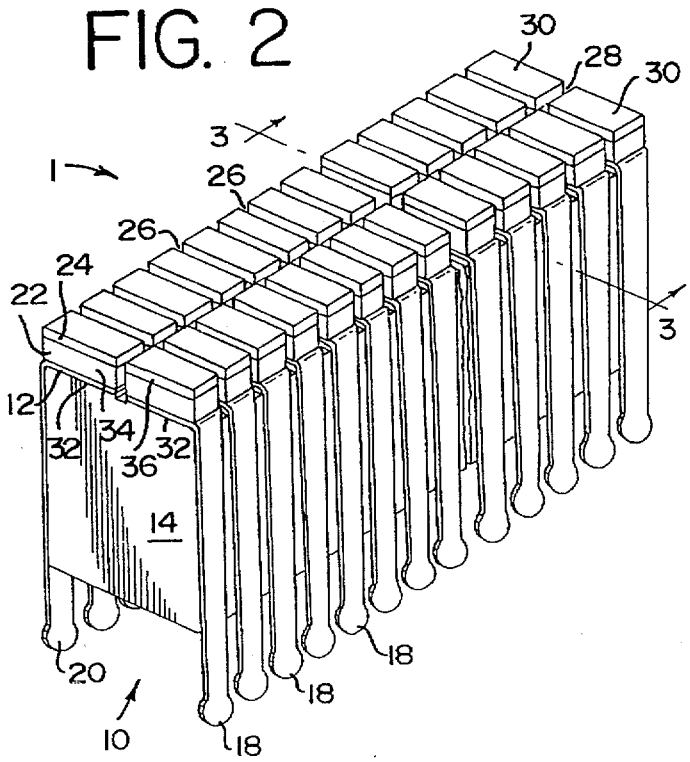
FIG. 2 is a perspective view of a first embodiment of the two-dimensional acoustic array of the present invention employing a single crystal design having a matching layer, and having two transducer segments in the elevation direction.
Figure 3:
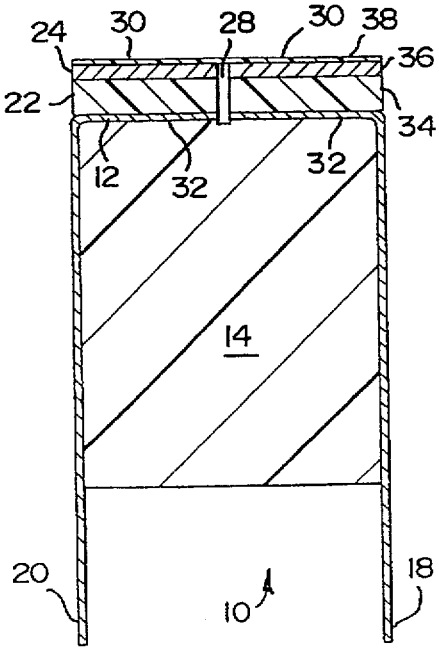
FIG. 3 is a cross-sectional view of the acoustic array of FIG. 2 taken along the lines 3—3 and also illustrating a mylar shield ground return.

Referring now to FIGS. 2 and 3, there is provided a high density two-dimensional acoustic array in accordance with a first preferred embodiment of the present invention. Referring also to FIG. 1(*a*), a first assembly 10 consists of an interconnecting circuit or flexible circuit 12 and a support structure or backing block 14. The backing block 14 serves to support the transducer structure. Although the upper surface of the backing block 14 supporting the transducer structure is shown to have a flat surface, this surface may comprise other shapes, such as a curvilinear surface. The flexible circuit 12 will eventually serve to provide the respective signal electrodes and corresponding traces or leads once the flexible circuit 12 is severed, as will be described. The first assembly 10 is also used to construct other embodiments of this invention.

Flexible circuit 12 has a center pad 16 which is disposed on the backing block 14. As shown in FIGS. 1 through 3, the flexible circuit 12 has a plurality of adjacent traces or leads 18 and 20 extending from opposing sides of the center pad 16. The flexible circuit 12 is typically made of a copper layer bonded to a piece of polyimid material, typically KAPTON-. Flexible circuits such as the flexible circuit 12 are manufactured by Sheldahl of Northfield, Minn. Preferably, the flexible circuit thickness is approximately 25 μm for a flexible circuit manufactured by Sheldahl.

Of course, materials other than the copper layer and polyimid material may be used to form the flexible circuit 12. The flexible circuit may comprise any interconnecting design used in the acoustic or integrated circuit fields, including solid core, stranded, or coaxial wires bonded to an insulating material, and conductive patterns formed by known thin film or thick film processes. In addition, the material forming the backing block 14 is preferably acoustically matched to the flexible circuit 12, resulting in better performance Further, the acoustic impedance of the flexible circuit is approximately equal to that of the epoxy material for gluing the flexible circuit 12 to the backing block 14, which is described later.

As shown in FIGS. 1(*b*), 2 and 3, a piezoelectric layer 22 is disposed on the center pad 16 of the flexible circuit 12 of the first assembly 10. In addition, an acoustic matching layer 24 may then be disposed on the piezoelectric layer 22 to further increase performance.

The piezoelectric layer 22 may be formed of any piezoelectric ceramic material such as lead zirconate titanate (PZT) or lead meaniobate. In addition, the piezoelectric layer 22 may be formed of composite material such as the composite material described in R. E. Newnham et al. "Connectivity and Piezoelectric-Pyroelectric Composites", Materials Research Bulletin, Vol. 13 at 525–36 (1978) and R. E. Newnham et al., "Flexible Composite Transducers", Materials Research Bulletin, Vol. 13 at 599–607 (1978). Alternatively, the piezoelectric layer 22 may be formed of polymer material polyvinylidene fluoride (PVDF).

The backing block may be formed of a filled epoxy comprising Dow Corning's part number DER 332 treated with Dow Corning's curing agent DEH 24 and has an aluminum oxide filler. In addition, preferably the matching layer is formed of a filled polymer. The matching layer may be coated with electrically conductive materials, such as nickel and gold.

Preferably, the backing block 14, the flexible circuit 12, the piezoelectric layer 22, and the matching layer 24 are glued to one another in one step by use of an epoxy adhesive. The epoxy adhesive is placed between the backing block 14 and the flexible circuit 12, between the flexible circuit 12 and the piezoelectric layer 22, and between the piezoelectric layer 22 and the matching layer 24. These layers are secured to one another by fixturing all layers together and applying pressure to the layers. Preferably, 60 psi is applied in order to secure the layers together.

Alternatively, the layers may be glued to one another at different stages (i.e., the flexible circuit may first be glued to the backing block and in a separate step, the piezoelectric layer is later secured to the flexible circuit). However, this increases the time for securing the layers to one another.

An epoxy of HYSOL® base material number 2039 having a HYSOL® curing agent number HD3561, which is manufactured by Dexter Corp., Hysol Division of Industry, Calif., may be used for gluing the various materials together. Preferably, the thickness of the epoxy material is approximately 2 μm or less.

As shown in FIG. 2, the center pad 16 of the flexible circuit 12, the piezoelectric layer 22 and the acoustic matching layer 24 are diced by forming kerfs 26 and 28 therein with a standard dicing machine. Kerfs 26, which are parallel to the elevation axis of the array 1, are located between adjacent traces 18 and adjacent traces 20. Preferably, the kerfs 26 are formed by dicing between adjacent traces 18 and 20 starting at one end of the array 1 and making parallel kerfs until reaching the other end of the array. The kerf 28 may be located parallel to the azimuthal axis of the array, preferably equidistant between the traces 18 and the traces 20, as shown in FIGS. 2 and 3. The kerfs 26 and 28 may extend a short distance into the backing block 14. Since the backing block 14 is not substantially cut (i.e., 5 to 10 thousandths of an inch in depth), piezoelectric layer 22 and acoustic matching layer 24 are still supported by the backing block 14.

As a result of the dicing operation, transducer segments 30 are formed, each segment 30 having an electrode 32, a piezoelectric portion 34 and an acoustic matching layer portion 36. The electrode 32, the piezoelectric portion 34, and the acoustic matching layer portion 36 are preferably coextensive in size along the azimuthal and elevation axes. Further, the traces 18 and 20 have a width which is substantially coextensive in size with a width of the electrode 32.

It is preferable that the traces 18 are aligned with the traces 20 parallel to the elevation axis of the array 1. This permits all transducer segments 30 arranged parallel to the elevation axis of the array 1 at a given azimuthal position to be cut at the same time by forming a single kerf 26. However, the traces 18 do not have to line up with the traces 20 to practice the invention. If the traces 18 are not aligned with the traces 20, additional dicing may be required. That is, dicing should be performed in a region between adjacent traces 18 and adjacent traces 20 in order to form the respective transducer segments.

An electrode or layer 38 may be placed over the acoustic matching layer portions 36, as shown in FIG. 3. The electrode 38 may be at common ground or alternatively at any appropriate reference potential. The electrode 38 is preferably a 12.5 μm MYLAR electrode coated with 2000–3000 Å of gold. The gold coating is placed on the MYLAR layer by use of sputtering techniques. This gold coating is preferably in contact with the matching layer portions 36 and may be applied by sputtering prior to applying the MYLAR layer. Further, 500 Å of chromium may be sputtered on the MYLAR layer prior to sputtering the gold coating in order to allow the gold coating to better adhere to the MYLAR layer.

The matching layer portions 36 are preferably electrically coupled to the electrode 38 via a metalization layer across the four edges of the matching layer portion. That is, both the upper surface and the four side edges of the matching layer portion are coated with electrically conductive material, shorting the electrode 38 to the respective piezoelectric portions 34. An electrically conductive matching layer material such as magnesium or a conductive epoxy may be used to short the electrode 38 to the piezoelectric portion 34. This results in an electroded acoustic matching layer.

Because the flexible circuit 12 is diced as described above, the center pad 16 of the flexible circuit 12 is formed into an individual electrode 32 for each of the transducer segments 30. The individual electrodes 32 electrically couple the signal for exciting the respective transducer segments 30 from the traces 18 and the traces 20, which are automatically and integrally formed with the respective electrodes 32 because of the dicing process. For a given transducer segment 30, the trace 18 or 20 and the electrode 32 are a one-piece member and are formed of the same material. However, the electrode 32 and trace 18 or 20 may be formed by other methods. For example, if the electrode 32 and trace 18 or 20 were formed by a thin film process on a composite ceramic material, there would be no need to dice between adjacent electrodes 32. In addition, there are two electrodes 32 and 38 for exciting a given transducer segment 30.

Referring to FIGS. 4 and 5, there is provided a second embodiment of the present invention where like components are labeled similarly to the first embodiment. Rather than having two transducer segments 30 arranged along the elevation direction, the second embodiment has three transducer segments **30*a*, 30*b*, and 30*c* arranged along the elevation direction. It is desirable, although not necessary to practice this invention, to have an odd number of transducer segments 30** arranged along the elevation direction for symmetry of construction.

Symmetry of construction is desirable because it allows focusing from a point in the near field to a point in the far field along the same scanning line without the need to otherwise shift the position of the transducer. When focusing in the near field, only the center segment is activated. When focusing in the far field, segments equidistant from the center segment are activated as well. Were the transducer to have an even number of segments, it may be necessary to reposition the transducer in order to effect focusing at a different point for a given scan line.

A joined assembly 50 is formed by severing the first assembly 10 of FIG. 1(*a*), forming a severed assembly 40, and bonding the severed assembly 40 to a second assembly 46 along bonding region 48. The first assembly 10 is severed along the longitudinal direction 4—4, shown in FIG. 1(*a*), to form the severed assembly 40, as shown in FIGS. 4 and 5. Preferably, the first assembly 10 is severed approximately along the line through the center pad 16 that is equidistant from the traces 18 and the traces 20. The severed assembly 40 contains the remaining backing block 42, the remaining flexible circuit 44 having remaining traces 45. The second half of the first assembly 10 may be discarded or used for constructing a second transducer array assembly.

The second assembly 46 is similar in construction to the first assembly 10 of FIG. 1(*a*). Preferably, the dimensions of the first assembly 10 and second assembly 46 are identical. The severed assembly 40 is bonded to the second assembly 46 by use of an epoxy adhesive, such as the HYSOL® epoxy adhesive described earlier.

A piezoelectric layer 22 is disposed on the joined assembly 50. An acoustic matching layer 24 may also be disposed on the piezoelectric layer 22. As described with regard to the two-dimensional array of FIG. 2, all of the gluing between layers as well as the gluing of the severed assembly 40 to the second assembly 46 are preferably performed in one step. Further, it is preferable to make sure that adjacent traces 20 line up with adjacent traces 18 and adjacent traces 45 This allows dicing at a given point along the azimuthal direction to be accomplished by one cut rather than a series of cuts.

It is preferable that the traces 18, 20, and 45 be aligned parallel to the elevation axis of the array. In order to help align the traces, tooling holes, not shown, may be placed along extensions, not shown, of the center pad 16 which extend in the azimuthal direction beyond both longitudinal ends of the backing block 14. Preferably, there are two such tooling holes at each end of the center pad 16 of the first assembly shown in FIG. 1(*a*). When the severed assembly 40 is formed, one tooling hole at each end of the extensions of the center pad 16 remains on the remaining flexible circuit 44. Further, the second assembly 46 has two tooling holes at each end. As a result, an operator may align the traces 45 of the severed assembly 40 with the traces 18 and the traces 20 of the second assembly 46.

As with the first embodiment, a dicing machine is then used to dice the center pad 16 of the flexible circuit 12, the remaining flexible circuit 44, piezoelectric layer 22 and acoustic matching layer 24. As described earlier, the kerfs extend only a short distance into the backing blocks. Dicing occurs between adjacent traces 20, 18, and 45.

A kerf 52 may be formed in a region of the remaining flexible circuit 44, piezoelectric layer 22, and acoustic matching layer 24 disposed approximately above the bonding region 48 between the severed assembly 40 and the second assembly 46. Preferably, the kerf 52 is formed along the severed edge of the severed assembly 40, beginning in the elevation direction just far enough away from the traces 18 so as not to cut through or disturb the flexible circuit 12, as best seen in FIG. 5. The kerf 52 should cut through the remaining flexible circuit 44 to ensure isolation between the remaining flexible circuit 44 and flexible circuit 12. Alternatively, the first assembly 10 may be severed such that the remaining flexible circuit 44 is isolated from flexible circuit 12 when the severed assembly 40 and the second assembly 46 are joined, i.e., the remaining flexible circuit 44 is cut where the kerf 52 would otherwise extend into remaining flexible circuit 44, so that there is no need for the kerf 52 to also sever the remaining flexible circuit 44.

Another kerf 54 is placed in a region of the flexible circuit 12, piezoelectric layer 22, and acoustic matching layer 24 above the second assembly 46, preferably near the longitudinal center line of the second assembly 46. Thus, individual transducer segments 30*a*, 30*b*, and 30*c* are formed. That is, for a given azimuthal position, three segments 30*a*, 30*b*, and 30*c* are formed along the elevation direction each having an electrode 32 with a trace 18, 20, or 45 integral therewith, a piezoelectric portion 34, and an acoustic matching layer portion 36. A common ground electrode 38 may be placed over the acoustic matching layer 36.

The traces 18, 20, and 45 may then be connected to the external circuitry for exciting the individual transducer segments 30*a*, 30*b*, and 30*c*. Preferably, the traces 20 and 45 for a given azimuthal position may be electrically connected by wire 56. A nosepiece or enclosure is placed around the transducer structure. This nosepiece may have a hole where a cable may be inserted, providing the electrical wires from the acoustic imaging system for exciting each of the respective transducer segments 30*a*, 30*b*, and 30*c*.

As with the first embodiment, because the flexible circuits 12 and 44 are diced as described above, the traces 18, 20, and 45 coupled to the respective transducer segments 30*a*, 30*b*, and 30*c* are automatically formed and are each integrally connected with the electrode 32 which is formed. The respective electrode 32 and trace 18, 20 or 45 form a one-piece member of the same material. In addition, the electrode 32 is coextensive in size with the piezoelectric portion 34 along the azimuthal and elevation axes. Thus, a dependable connection is made from each trace 18, 20, or 45 feeding the signal to the appropriate electrode 32, as well as between the electrode 32 and the piezoelectric portion 34 of the respective transducer segment 30*a*, 30*b*, and 30*c*. In order to further increase electrical coupling between the flexible circuits 12 and 44 and the respective transducer piezoelectric portion 34, the flexible circuits may be gold plated.

When forming a transducer array 1 having three segments along the elevation direction, as shown in FIG. 4, the dimension of the backing block 14 preferably is 1.5 cm in the elevation direction, 2.5 cm in the azimuthal direction, and 2 cm in the range direction. In addition, the center pad 16 preferably is coextensive in size with the backing block 14 along the azimuthal and elevation axes. The traces 18, 20 and 45 preferably have a width 19, shown in FIG. 1, of 50 to 100 μm. In addition, the spacing between the traces are typically one-half to two times the wavelength of the operating frequency in the body being examined.

Further, the dimension of the piezoelectric layer 22 for the construction shown in FIG. 4 is preferably 1.5 cm in the elevation direction, 2.5 cm in the azimuthal direction, and 0.25 mm in the range direction. The dimension of the matching layer 24 is preferably 1.5 cm in the elevation direction, 2.5 cm in the azimuthal direction, and 0.125 mm in the range direction. The kerfs 26 are preferably approximately 50.8 μm in width. The kerfs 52 and 54 are preferably 101.6 μm in width.

Figure 6A:
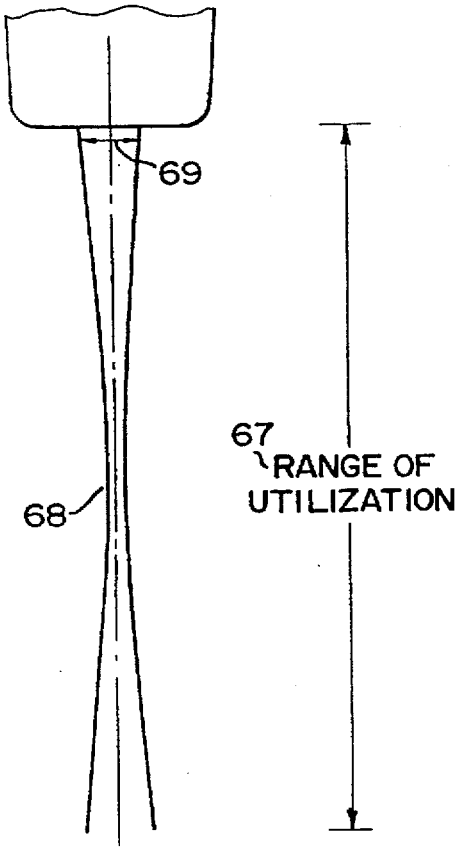
FIGS. 6(*a*) and (*b*) are beam profiles showing performance of the transducer design of FIG. 4 by firing only the center segment in the near field and firing the full aperture in the far fields
Figure 6B:
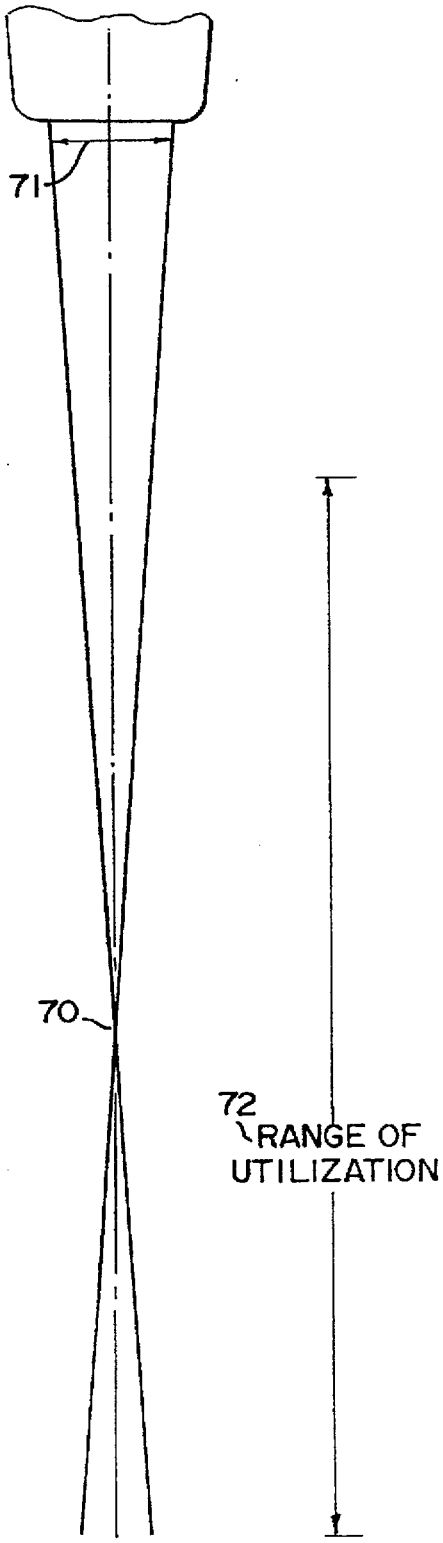

FIG. 6 illustrates a beam profile in accordance with the principles of this invention. FIG. 6(*a*) illustrates beam 68 which is the beam profile for focusing in the near field where only the center transducer segments 30*a* of the two-dimensional array 1 are activated for the construction shown in FIG. 4, The range of utilization 67 is 0 to approximately 5 to 6 cm. In addition, the aperture width 69 of the exiting beam is approximately 5 mm. FIG. 6(*b*) illustrates beam 70, which is the beam profile for focusing in the far field. The range of utilization 72 is approximately 5 cm to 20 cm. Further, the aperture width 71 of the exiting beam is approximately 15 mm. In the far field, the full aperture is activated, resulting in more energy for larger depth of penetration. Because the aperture may be expanded when focusing in the far field, higher frequency imaging can be achieved without sacrificing near field image quality. Thus, clearer images may be produced.

Although FIGS. 4 and 5 show a single second assembly 46 being combined with a single severed assembly 40, additional severed assemblies 40 may be appropriately bonded to the joined assembly 50. Thus, four or more transducer segments 30 may be provided along the elevation axis. Preferably, an odd number of transducer segments 30 are provided in the elevation direction for symmetry of construction. Should an odd number of transducer segments 30 be chosen, then segments equidistant from the center segment may be electrically connected, as shown by the wire 56 in FIG. 5. Further, one or more joined assemblies 50 may be combined if the traces at the binding region are appropriately electrically isolated from one another.

For example, if a high density two-dimensional array 1 is employed having five transducer segments 30 in the elevation direction, then the outer two segments may be electrically joined together and the second and fourth segments may be electrically joined together. In order to form such a construction, two severed assemblies 40 may be bonded at each end of the construction shown in FIG. 4 whereby each of the traces 45 for a given severed assembly 40 is placed on the side opposing the bonding region 48.

Although with the configurations shown in FIGS. 1 through 5, the flexible circuit 12 lies below the electrode layer 38, the electrode layer may be placed directly above the backing block, as shown in FIG. 7. In this alternate embodiment, the piezoelectric layer 22 is placed above the electrode layer 38, the center pad 16 of the flexible circuit 12 is placed above the piezoelectric layer 22, and an acoustic matching layer 24 may be disposed upon the center pad 16 of the flexible circuit 12 if a matching layer is used. The width of the electrode 38, the piezoelectric layer 22, and the matching layer 24 are preferably 0.5 mm shorter at each end of the backing block. This will later allow for electrical isolation between the electrodes to be formed. As described earlier, the ground layer may be at common ground or any appropriate reference potential and the acoustic matching layer may be an electroded acoustic matching layer.

When dicing the assembly to form the individual transducer segments 30, only the flexible circuit 12, the acoustic matching layer 24, and the piezoelectric layer 22 would be severed. The kerfs would not necessarily extend into the common ground electrode or the backing block. As a result, a top electrode would couple the excitation signal to a corresponding transducer segment from a trace which is formed of the same material as that respective top electrode, forming a one-piece member. Further, an array with three segments 30 in the elevation direction may be constructed from a first assembly joined to a second assembly, as previously described with respect to FIGS. 4 and 5, wherein the cross-section of each transducer segment is as shown in FIG. 7.

Figure 8:
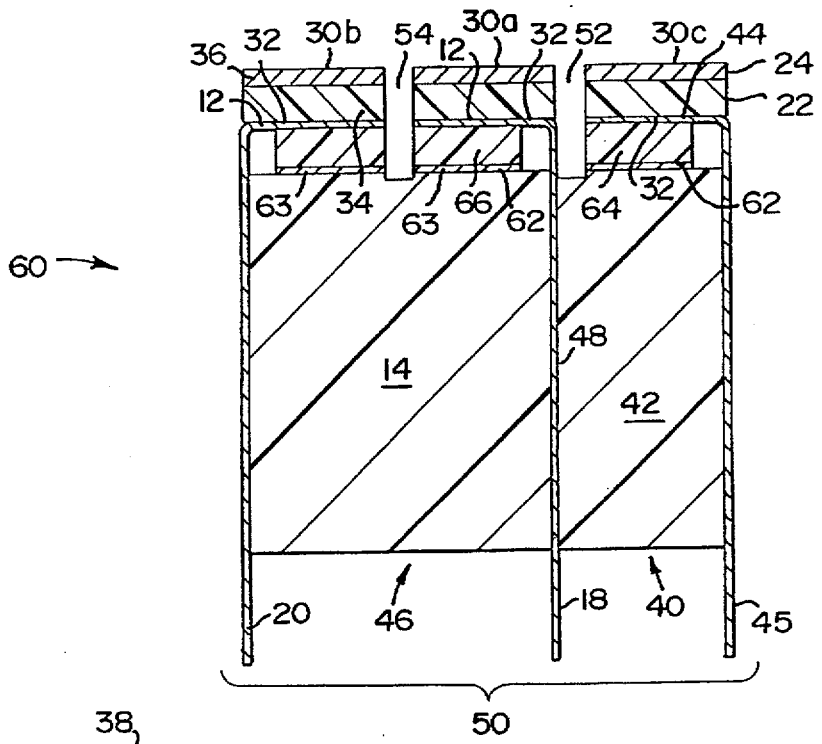
FIG. 8 is a cross-sectional view of a fourth embodiment of the present invention employing a two crystal design having a matching layer and three segments in the elevation direction.
Figure 9:
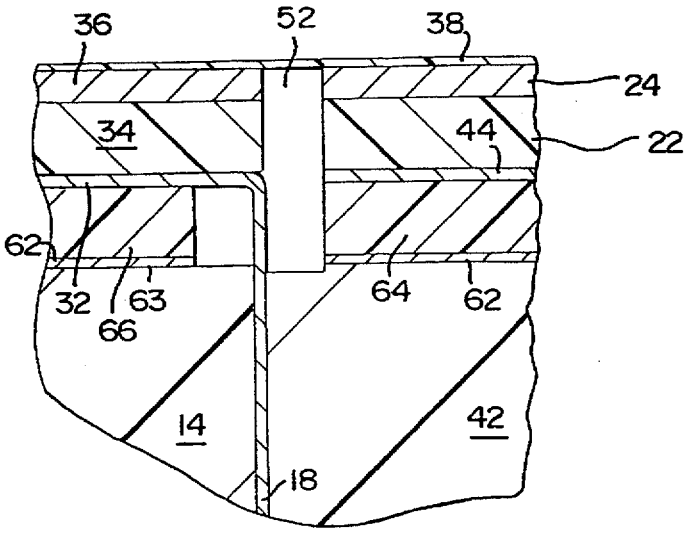
FIG. 9 is an enlarged view of the connection between the two backing blocks of FIG. 8 and also illustrating the mylar shield ground return.

Now referring to FIGS. 8 and 9, there is shown an alternate embodiment for a two crystal design 60 wherein like components are labeled similarly. The two crystal design differs from the single crystal design shown in FIGS. 2 through 5 in that a first ground layer 62 is placed above the backing block 14 and a first piezoelectric layer 64 is disposed above the ground layer 62. Thus, referring also to FIG. 1(*a*), both a ground layer 62 and a first piezoelectric layer 64 would be placed above backing block 14 and below the center pad 16 of flexible circuit 12, forming a first assembly 10. The width of the first ground layer 62 and the first piezoelectric layer 64 are preferably 0.5 mm shorter at each end of the backing block 14. This will later allow for electrical isolation between the electrodes to be formed. This first assembly 10 is severed as was done with the single crystal design, forming a severed assembly 40. The severed assembly 40 is bonded to a second assembly 46 preferably having similar dimensions to the first assembly 10 along bonding region 48.

As with the embodiments of FIGS. 4 and 5, a second piezoelectric layer 22 is disposed above the joined assembly 50. To further increase performance, an acoustic matching layer 24 may also be disposed above the second piezoelectric layer 22. Then, as before, the joined assembly is diced in the azimuthal direction with kerfs between the adjacent traces 18, 20, and 45. The layers and assemblies are bonded together as described earlier.

Once the dicing is complete, a kerf 52 may sever the acoustic matching layer 24, second piezoelectric layer 22, remaining flexible circuit 44, first piezoelectric layer 64 and ground layer 62. This ensures that the segments to be formed (i.e., the segments above the remaining backing block 42) are electrically isolated from the adjacent segments along the elevation direction. The kerf 52 is parallel to the azimuthal axis and, as described in regard to FIG. 5, is located above the bonding region 48 between the severed assembly 40 and the second assembly 46.

Another kerf 54 may also be placed in a region above the second assembly 46, preferably near the centerline of the second assembly. The kerf 54 should cut acoustic matching layer 24 into matching layer portions 36, second piezoelectric layer 22 into piezoelectric portions 34, flexible circuit 12 into electrodes 32 having traces 18, 20 integral therewith, and first piezoelectric layer into first piezoelectric portions 66 and electrode layer 62 into electrodes 63. Once this is complete, a mylar shield ground return 38, as described earlier, may be placed above the acoustic matching layer portions 36. This ground return 38 is electrically connected to ground layers 62. The two crystal design results in a more sensitive transducer probe.

In a preferred operation of the two-dimensional array shown in FIGS. 4 and 8, the transducer array 1 may first be operated at a higher frequency (e.g., 5 MHz) along a given scan line in order to focus the ultrasound beam at a point in the near field. When imaging in the near field, typically one to six centimeters in depth of the object of interest, only the center segments 30*a* of the array 1 are activated. Thus, an excitation signal is provided to traces 18. As the transducer array 1 is gradually focused along successive points along the scan line, the outer segments 30*b* and 30*c* may also be activated. An excitation signal is provided to traces 18, 20, and 45. Thus, the elevation aperture is expanded and more energy penetrates into the body, producing clearer images in the far field. When using the embodiment shown in FIGS. 4 and 8, it is preferable that the outer traces for a given azimuthal position be connected by the wire 56 in order to simplify construction. Thus, only one electrical signal is required to activate an outer segment 30*b* and a corresponding outer segment 30*c* when focusing in the far field.

Figure 10:
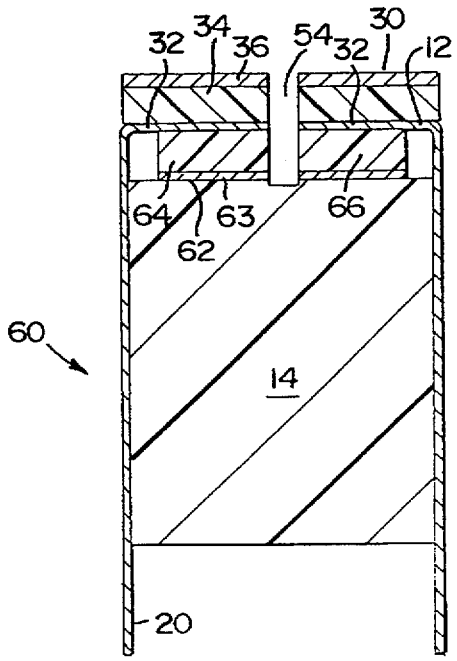
FIG. 10 is a cross-sectional view of a fifth embodiment of the present invention employing a two crystal design having a matching layer and two segments in the elevation direction.

It should be noted that even though a two-crystal design was shown in FIGS. 8 and 9 having three segments in the elevation direction, a two-crystal design having two segments may be provided, as illustrated in FIG. 10. With such a construction, the severed assembly 40 would not be bonded to the second assembly 46. Rather, the piezoelectric layer 22 and acoustic matching layer 24 would be placed directly on the flexible circuit 12, dicing between the adjacent traces 18 and 20, and placing the kerf 54 in a region above backing block 14. Should more than three segments be required along the elevation axis, then the appropriate number of severed assemblies 40 may be bonded on each side of the second assembly 46, placing a kerf 52 for each severed assembly employed above the bonding region 48. In addition, each of the embodiments described may be used with commercially available units such as Acuson Corporation's 128 XP System having acoustic response technology (ART) capability.

It is to be understood that the forms of the invention described herewith are to be taken as preferred examples and that various changes in the shape, size and arrangement of parts may be resorted to, without departing from the spirit of the invention or scope of the claims.

We claim:

1. A method of constructing a two-dimensional transducer array comprising the steps of:

forming a first assembly by disposing a first flexible circuit having a center pad and a plurality of traces extending from opposing sides of said center pad on a first backing block;

forming a severed assembly having a first plurality of traces by severing said first backing block and said first flexible circuit through said center pad of said first assembly to separate traces at said opposing sides;

forming a second assembly by disposing on a second backing block a second flexible circuit having a center pad, a second plurality of traces extending from opposing sides of said center pad, and a third plurality of traces on said opposing end of said center pad;

forming a joined assembly by bonding said severed assembly to said second assembly wherein said second plurality of traces opposes said first plurality of traces;

disposing a piezoelectric layer on said joined assembly;

dicing said piezoelectric layer and said first and second flexible circuits on said joined assembly to form transducer segments each having a trace coupled thereto; and disposing an electrode layer on said piezoelectric layer.

2. The method of claim 1 wherein said first and second assemblies are similar in dimension and said first assembly is severed approximately along a center of said first assembly.

3. The method of claim 2 wherein a kerf is formed approximately along a center of said second assembly.

4. The method of claim 1 further comprising the step of disposing an acoustic matching layer on said piezoelectric layer prior to dicing.

5. The method of claim 1 wherein, for a given point on an azimuthal axis, said second and third plurality of traces on said second assembly are in alignment.

6. The method of claim 1 wherein, for a given point on an azimuthal axis, said first, second, and third plurality of traces are in alignment.

7. The method of claim 1 further comprising the step of disposing an electrode layer on said piezoelectric layer prior to dicing.

8. The method of claim 7 further comprising the step of connecting said first and said third traces for a given point along an azimuthal axis.

9. The method of claim 1 further comprising the step of providing an excitation signal to said second plurality of traces when focusing in a near field and providing an excitation signal to said first, second, and third plurality of traces when focusing in a far field.

10. A method of constructing a two-dimensional transducer array comprising the steps of:

forming a first assembly having a piezoelectric layer, a flexible circuit having a center pad and a plurality of traces extending from opposing sides of said center pad and an electrode wherein said piezoelectric layer has a first surface coupled to said center pad of said flexible circuit and a second surface coupled to said electrode;

forming a severed assembly having a first plurality of traces by severing said first assembly substantially in half along an azimuthal direction through said center pad of said flexible circuit;

forming a second assembly having a piezoelectric layer, a flexible circuit having a center pad and a second plurality of traces extending from one end of said center pad and a third plurality of traces extending from another end of said center pad, and an electrode wherein said piezoelectric layer has a first surface coupled to said center pad and a second surface coupled to said electrode; and forming a joined assembly by bonding said severed assembly to said second assembly wherein said second plurality of traces opposes said first plurality of traces.

11. A method according to claim 10 wherein said piezoelectric layer of said first and second assemblies is disposed on top of said center pad of said flexible circuits.

12. A method according to claim 10 wherein said flexible circuits of said first and second assemblies is disposed on top of said piezoelectric layer.

13. A method according to claim 10 further comprising the step of forming a key through the electrode, piezoelectric layer and center paid of said flexible circuit in said second assembly.

14. A method according to claim 12 further comprising the step of disposing a second piezoelectric layer on said flexible circuits of said first and second assemblies.

15. A method according to claim 10 further comprising the step of disposing an acoustic matching layer on said piezoelectric layers.

16. A method according to claim 10 further comprising the step of forming a kerf through the electrode, piezoelectric layer and center paid of said flexible circuit in said first assembly.

* * * * *

UNITED STATES PATENT AND TRADEMARK OFFICE

CERTIFICATE OF CORRECTION

PATENT NO. : 5,894,646
DATED : April 20, 1999
INVENTOR(S) : Amin M. Hanafy et al.

It is certified that error appears in the above-indentified patent and that said Letters Patent is hereby corrected as shown below:

On the Title Page

In column 1, Item [75], line 2, replace "Ohio" with --CA--

In column 3, line 17, replace "are" with --is--.

In column 3, line 46, replace "fields" with --field.--.

In column 4, line 33, immediately after "performance" insert --.-- (period).

In column 7, line 6, immediately after "traces 45" insert --.-- (period).

In column 8, line 43, immediately after "FIG. 4" replace "," with --.-- (period).

UNITED STATES PATENT AND TRADEMARK OFFICE

CERTIFICATE OF CORRECTION

PATENT NO. : 5,894,646

DATED : April 20, 1999

INVENTOR(S) : Amin M. Hanafy et al.

It is certified that error appears in the above-indentified patent and that said Letters Patent is hereby corrected as shown below:

In claim 13, line 3, replace "paid" with --pad--.

In claim 16, line 3, replace "paid" with --pad--.

Signed and Sealed this

Seventh Day of December, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,894,646

DATED : April 20, 1999

INVENTOR(S) : Amin M. Hanafy et al.

It is certified that error appears in the above-identified patent and that said Letters Patent is hereby corrected as shown below:

On the Title Page:

In column 1, Item [75], line 2 replace "ohio" with --CA--; and in line 3, replace "Colo." with --CA--.

Signed and Sealed this

Sixteenth Day of May, 2000

*Attest:*

Q. TODD DICKINSON

*Attesting Officer*

*Director of Patents and Trademarks*